United States Patent [19]

Fujita et al.

[11] Patent Number: 4,851,619

[45] Date of Patent: Jul. 25, 1989

[54] MINIATURE SWITCH

[75] Inventors: Yasushi Fujita; Akira Saito, both of Tokyo, Japan

[73] Assignee: Nihon Kaiheiki Industrial Company Ltd., Tokyo, Japan

[21] Appl. No.: 156,861

[22] Filed: Feb. 17, 1988

[30] Foreign Application Priority Data

Sep. 1, 1987 [JP] Japan ..... 62-132277[U]

[51] Int. Cl.[4] ..... H01H 21/00

[52] U.S. Cl. ..... 200/6 R; 335/106; 361/400; 361/404

[58] Field of Search ..... 200/6 R, 15, 16 F, 68.1, 200/68.2, 68.3, 254, 339, 292; 361/400, 402, 403, 404, 405, 406; 335/106, 107

[56] References Cited

U.S. PATENT DOCUMENTS

| | | | |
|---|---|---|---|
| 3,525,827 | 8/1970 | Allison | 200/110 |
| 4,075,442 | 2/1978 | Fukuda et al. | 200/16 F |
| 4,371,767 | 2/1983 | Ohashi et al. | 200/254 X |

*Primary Examiner*—A. D. Pellinen

*Assistant Examiner*—Morris Ginsburg

*Attorney, Agent, or Firm*—Armstrong, Nikaido, Marmelstein, Kubovcik & Murray

[57] ABSTRACT

A miniature switch includes an actuator block operated by a toggle lever, a switch base having fixed contacts arranged on a top side thereof and terminals, which are formed integral with the fixed contacts, arranged on a bottom side thereof, and a movable contactor operatively associated with the actuator block for slidingly contacting mutually adjacent ones of the fixed contacts. The fixed contacts and the terminals are integrally formed. The fixed contacts are implanted in the switch base in first and second rows each of which includes a plurality of the fixed contacts. The first and second rows are arranged on the top side of the switch base symmetrically with respect to a center line and are spaced apart equidistantly. The terminals of the fixed contacts in these first and second rows are arranged to project from the bottom side of the switch base in a substantially linear, single row in which the terminals are mutually spaced apart substantially equidistantly.

3 Claims, 3 Drawing Sheets

Fig. 3(a)
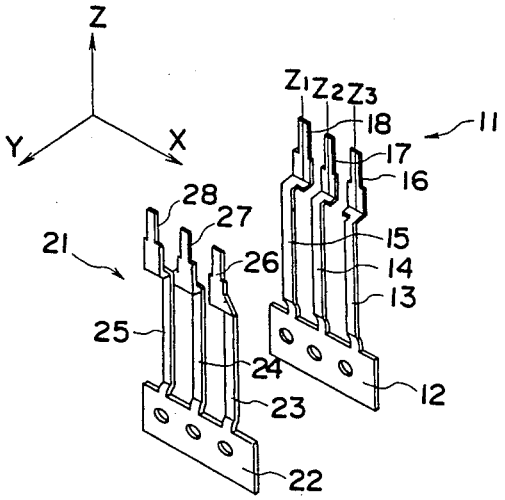
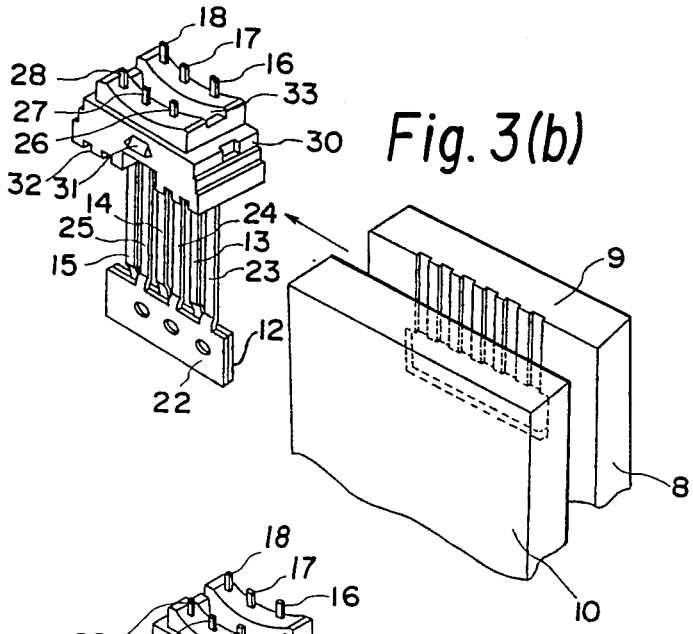
Fig. 3(b)
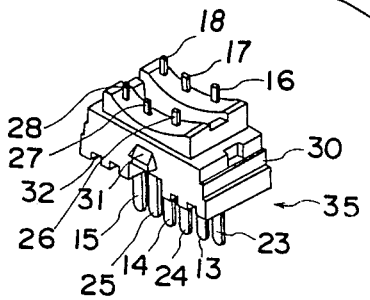
Fig. 3(c)

MINIATURE SWITCH

BACKGROUND OF THE INVENTION

This invention relates to a miniature switch having fixed contacts arranged in two rows on the top side of a switch base, and terminals connected with the fixed contacts and arranged in a single linear row on the bottom side of the switch base.

A conventional miniature switch includes a switch toggle lever, an actuator block operated by the toggle lever, a movable contactor which moves together with the actuator block, and fixed contacts which are selectively contacted by the movable contactor. The fixed contacts are arranged in two rows on the top side of a switch base, and each fixed contact has a terminal formed integral therewith. The terminals are similarly arrayed in two rows corresponding to the fixed contacts and are led out from the bottom side of the main body of the switch. When the miniature switch is mounted on a printed circuit board, the distal end portions of the two rows of terminals led out from the rear side of the switch main body, namely from the side opposite the toggle lever, are connected to printed wiring patterns on the printed circuit board.

However, when the conventional switch described above is mounted on the printed circuit board, a large amount of labor is expended in bending the terminals and the fact that the switch occupies a large area of the printed circuit board is an impediment to reducing the size of the device using the switch.

SUMMARY OF THE INVENTION

An object of the present invention is to make it possible to mount switches having the same shape in a variety of conditions and, moreover, to make it possible to array the terminals in one row in the same direction along the switch base even if the switch is attached to a printed circuit board transversely.

In a preferred embodiment of the present invention, a miniature switch comprises an actuator block operated by a toggle lever, a switch base having fixed contacts arranged on a top side thereof and terminals, which are formed integral with the fixed contacts, arranged on a bottom side thereof, and a movable contactor operatively associated with the actuator block for slidingly contacting mutually adjacent ones of the fixed contacts. The fixed contacts are implanted in the switch base in first and second rows each of which includes a plurality of the fixed contacts. The first and second rows are arranged on the top side of the switch base symmetrically with respect to a center line and are spaced apart equidistantly. The terminals of the fixed contacts in these first and second rows are arranged to project from the bottom side of the switch base in a substantially linear, single row in which the terminals are mutually spaced apart substantially equidistantly.

Accordingly, the terminals can be bent in a simple manner. In mounting the switch on a printed circuit board, the switch main body can be easily attached in a variety of conditions in accordance with the space in the device using the switch.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 3 is a process view illustrating a method of manufacturing a switch base of the miniature switch;

DESCRIPTION OF THE PREFERRED EMBODIMENT

Figure 1:
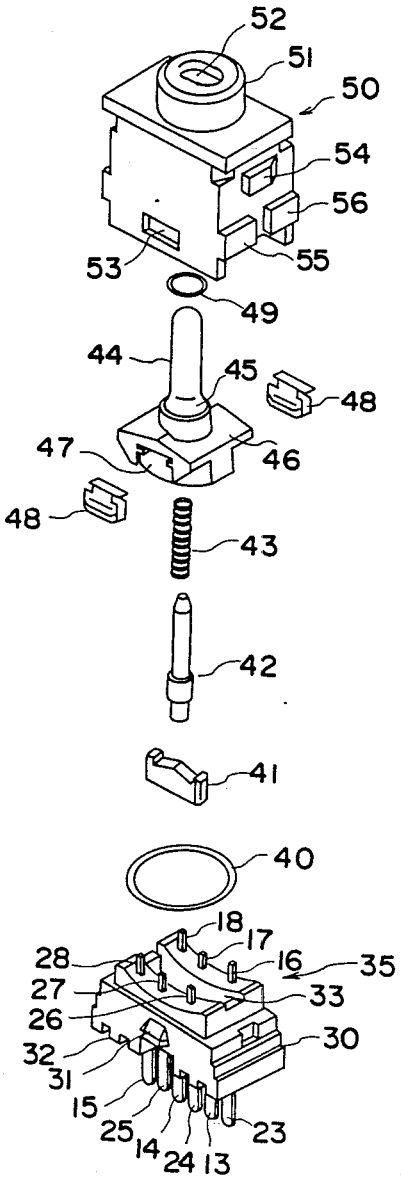
FIG. 1 is an exploded perspective view illustrating a first embodiment of a miniature switch according to the present invention.

Embodiments of the present invention will now be described in detail with reference to the drawings.

First, a method of manufacturing a switch base will be simply described in conjunction with FIG. 3.

A first blanked member 11 has a common strip 12 and three finger-shaped pieces extending therefrom. The finger-shaped pieces have respective terminals 13, 14, 15 connected to the common strip 12, bent portions formed along the -y axis in order to be spaced away from fixed contacts of a second blanked member which is to oppose the first blanked member, and respective fixed contacts 16, 17, 18 provided on the distal ends of the bent portions.

A second blanked member 21 has a shape exactly the same as that of the first blanked member 11. As shown in (a) of FIG. 3, the first and second blanked members 11, 21 are faced toward each other in such a manner that the second blanked member 21 is turned away from the first blanked member 11.

Accordingly, the second blanked member 21 has a common strip 22 and three finger-shaped pieces extending therefrom, just as the first blanked member 11. The finger-shaped pieces have respective terminals 23, 24, 25 connected to the common strip 22, bent portions formed along the y axis in order to be spaced away from fixed contacts of a first blanked member 11 which is to oppose the second blanked member, and respective fixed contacts 26, 27, 28 provided on the distal ends of the bent portions.

When the first blanked member 11 and second blanked member 21 are assembled, the fixed contacts 16 and 26, 17 and 27, 18 and 28 of the first and second blanked members 11, 21 are brought into accurate opposition with each other and the terminals are arranged into a single row.

In order to obtain a fixed spacing between terminals 23 and 13, 13 and 24, 24 and 14, 14 and 25 and 25 and 15, the terminal 13 is offset along the x axis with respect to a center line $Z_3$ of fixed contact 16, the terminal 14 is offset along the x axis toward minus direction respect to a center line $Z_2$ of fixed contact 17, and the terminal 15 is offset widely along the x axis toward minus direction with respect to a center line $Z_3$ of fixed contact 18.

Similarly, in the second blanked member 21, the terminal 23 is offset widely along the x axis with respect to a center line $Z_1$ of fixed contact 26, the terminal 24 is offset along the x axis with respect to a center line $Z_2$ of fixed contact 27, and the terminal 25 is offset along the x axis toward minus direction with respect to a center line $Z_3$ of fixed contact 28.

The first blanked member 11 and second blanked member 21 are then faced toward each other in the manner shown in (a) of FIG. 3.

Next, the common strips 12, 22 are overlapped, the common strips 12, 22 and terminals 13, 14, 15, 23, 24, 25 are inserted into the groove 9 of a bottom mold 8, and in this state the first and second blanked members are subjected to pressing by a bottom mold 10. Next, in order to mold an insulative synthetic resin in the portions situated between the fixed contacts and between the terminals, a top mold (not shown) is set and a base 30 comprising a molded resin is injection molded, as shown in (b) of FIG. 3. The base 30 is formed to include a projection 31 on its front and back surfaces, an accommodating groove 32 for receiving each terminal when the terminal is bent, and an accommodating groove 33 for receiving a detent provided between the two rows of fixed contacts.

Next, as shown in (c) of FIG. 3, the common strips 12, 22 of the first and second blanked members 11, 21 are cut off. Thus, there is obtained a switch base having fixed contacts arrayed in two rows and terminals arrayed in one row.

Figure 2:
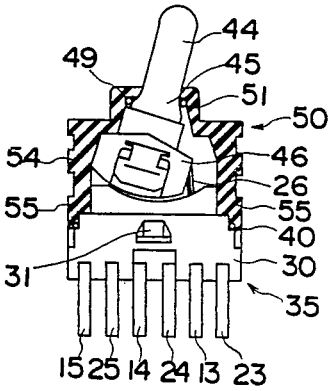
FIG. 2 is a sectional view illustrating the first embodiment of the miniature switch of the present invention.

The construction of a miniature switch embodying the present invention will now be described with reference to FIGS. 1 and 2.

An O-ring 40 is interposed between the switch base 30 and the main body of the switch in order to provide waterproof and dustproof properties. A detent 41 is disposed in the accommodating groove 33, and the lower end of a plunger 42 is abutted against the detent 41. The upper end of the plunger 42 is fitted into a hole (not shown), which is formed in the central portion of the actuator block 46 at the lower part thereof, via a coil spring 43.

A toggle lever 44 has an enlarged portion 45 at which the toggle lever 44 is connected to the actuator block 46. The front and back of the actuator block 46 are formed to include a recess 47 which receives a clip-shaped movable contactor 48. An O-ring 49 is securely fitted onto the outer periphery on the upper part of the enlarged portion 45 of toggle lever 44 and is used to assure a waterproof and dustproof condition.

The switch has a main body 50 the upper side of which is equipped with a sleeve 51. The upper end of the sleeve 51 is formed to include an opening 52, through which the toggle lever 44 is passed The above-mentioned projections 31 of the switch base 35 are fitted into holes 53 formed in the front and back of the switch main body 50. Protrusions 54, 55, 56 perform a positioning function when attaching a mounting plate.

Figure 4:
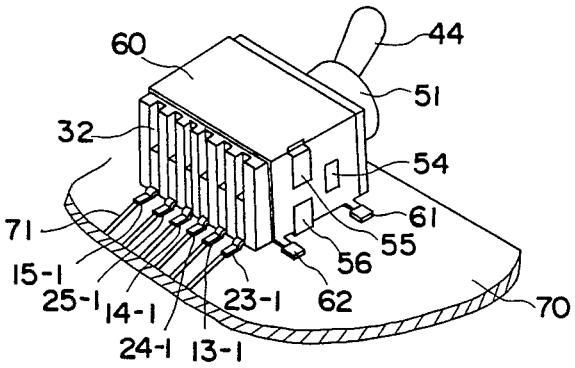
FIG. 4 is a perspective view illustrating the miniature switch of the invention in a state mounted transversely on a printed circuit board.

FIG. 4 is a perspective view illustrating the above-described miniature switch in a state mounted transversely on a printed circuit board.

A mounting plate 60 having holes corresponding to the protrusions 54, 55, 56 surrounds three sides of the switch main body. Mounting pieces 61, 62 extend from distal end portions on both sides of the mounting plate 60 and are secured to the printed circuit board by being soldered thereto. Distal end portions 23-1, 3-1, 24-1, 14-1, 25-1 and 15-1 of the terminals bent along the respective accommodating grooves 32 at the lead-out portion of the base 30 are bent further at right angles and then surface-mounted to printed wiring patterns 71 on a printed circuit board 70 by being soldered to the wiring patterns.

By virtue of this arrangement, the miniature switch can be surface-mounted on the printed circuit board 70 in a simple manner by the distal end portions 3-1, 13-1, 24-1, 14-1, 25-1, 15-1 of the terminals and mounting pieces 61, 62 upon bending the single row of terminals 23, 13, 24, 14, 25, 15 onto the side of the printed circuit board.

A second embodiment of a compact switch according to the present invention will now be described with reference to FIGS. 5 and 6.

Figure 5:
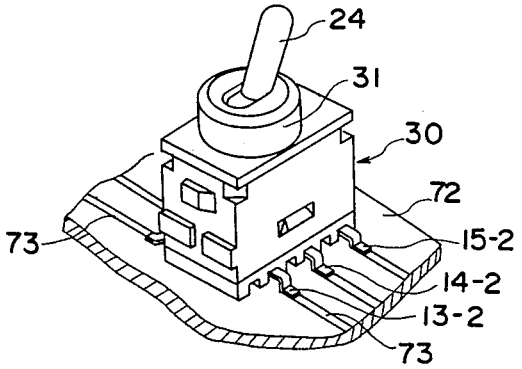
FIG. 5 is a perspective view illustrating a second embodiment of a miniature switch according to the invention in a state where the switch is mounted on a printed circuit board with a manipulating portion of the switch facing upward.
Figure 6:
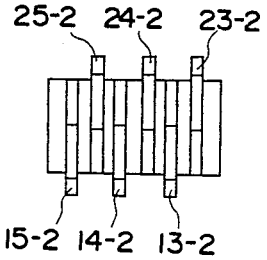
FIG. 6 is a rear view of the miniature switch shown in FIG. 5.

As shown in FIGS. 5 and 6, the miniature switch can be surface-mounted on a printed circuit board 72 solely by the terminals, and a mounting plate is unnecessary. More specifically, the terminals are alternately allotted to the left and right sides. In other words, the terminals are bent at the lead-out portion of the base 30 in such a manner that the distal end portions 23-2, 24-2, 25-2 of the terminals are arrayed on one longitudinal side of the switch and the distal end portions 13-2, 14-2, 15-2 of the terminals are arrayed on the opposite longitudinal side of the switch. These distal end portions of the terminals are connected and secured to printed wiring patterns 73 by being soldered thereto.

It should be noted that the present invention is not limited to the foregoing embodiments but can be modified in various ways based on the gist of the invention without departing from the scope of the claims.

In accordance with the present invention as described in detail hereinabove, the following advantages are obtained:

(1) Two rows of fixed contacts each of which comprises a plurality of fixed contacts are implanted symmetrically in the upper surface of a switch base, and the terminals of these fixed contacts project from the bottom of the switch base in a substantially linear single row, with the spacing between mutually adjacent terminals being equal. As a result, the terminals can be bent in a simple manner and the switch can readily be attached in various conditions to a printed circuit board that conforms to the device using the switch. With regard to mounting the switch on the printed circuit board, balance is maintained and the switch can be attached in a stable manner. Thus, the miniature switch of the invention is ideal for use as a surface-mounted switch.

(2) Two rows of fixed contacts each of which comprises a plurality of fixed contacts are implanted symmetrically in the upper surface of a switch base, and the terminals of these fixed contacts project from the bottom of the switch base substantially linearly, with the spacing between mutually adjacent terminals being equal. Therefore, after the switch is surface-mounted on a printed circuit board, there is no danger of the switch being torn off or dislodged from the circuit board when the toggle lever is manipulated. Accordingly, this completely eliminates the instability encountered in the surface mounting of the conventional switch when the switch is manipulated.

(3) Since the fixed contacts can be arrayed in two rows even though the terminals are arrayed in a single linear row, a sufficient isolation distance can be obtained between mutually adjacent fixed contacts. This makes it possible to obtain a highly stable miniature switch devoid of short-circuit accidents due to metal fragments produced by sliding the movable contactor, as well as accidents caused by vibration, impact or the like.

(4) Since the fixed contacts can be arrayed in two rows even though the terminals are arrayed in a single linear row, the space inside the switch main body can be exploited without waste. This makes it possible to obtain a miniature switch having a compact, simple structure.

(5) Unlike the conventional switch for two circuits in which the terminals are arrayed in two rows, the switch of the present invention has the terminals arrayed in a single row. Therefore, even if the switch is attached transversely, the space occupied on a printed circuit board can be reduced, thereby enabling miniaturization of the device using the switch.

(6) Unlike the conventional switch for two circuits in which the terminals are arrayed in two rows, the switch of the present invention has the terminals arrayed in a single row. Therefore, even if the switch is attached transversely, the circuit patterns on the circuit board will not be complicated. This facilitates inspection and repairs after soldering.

What we claim is:

1. A switch base having a plurality of fixed contacts for use in a miniature switch, comprising:

a base having an upper and lower surfaces;

a pair of rows of fixed contacts projecting out of said upper surface, each row having at least three fixed contacts, each of said fixed contacts being bent within said base and projecting out of said lower surface on substantially a longitudinal central axis of said lower surface with a small clearance therebetween to form a single row of straight terminals; and a plurality of lateral grooves provided on said lower surface, each of said lateral grooves passing each of said terminals projecting out of said lower surface.

2. The switch base according to claim 1, wherein each terminal is further bent along same direction within each lateral groove.

3. The switch base according to claim 1, wherein said terminals are further bent along opposite directions alternatively within said lateral grooves.

* * * * *